US007097467B2

(12) United States Patent
Chen

(10) Patent No.: US 7,097,467 B2
(45) Date of Patent: Aug. 29, 2006

(54) DUSTPROOF PLATE FIXTURE FOR AN ELECTRICAL CONNECTOR

(76) Inventor: Wan-Tien Chen, 10F, No. 106-2, Sec. 2, Chungshan N. Rd., Taipei (TW)

( * ) Notice: Subject to any disclaimer, the term of this patent is extended or adjusted under 35 U.S.C. 154(b) by 0 days.

(21) Appl. No.: 10/700,835

(22) Filed: Nov. 3, 2003

(65) Prior Publication Data

US 2004/0092166 A1 May 13, 2004

Related U.S. Application Data

(63) Continuation-in-part of application No. 10/162,517, filed on Jun. 3, 2002, now abandoned.

(51) Int. Cl.
*H01R 12/20* (2006.01)

(52) U.S. Cl. ..... 439/79; 439/567

(58) Field of Classification Search ..... 439/79, 439/80, 78, 607, 569–573, 567
See application file for complete search history.

(56) References Cited

U.S. PATENT DOCUMENTS 5,249,974 A * 10/1993 Wang ..... 439/79
5,340,320 A * 8/1994 Puerner ..... 439/79
5,354,207 A * 10/1994 Chikano ..... 439/79
5,531,604 A * 7/1996 Huang ..... 439/79
6,135,789 A * 10/2000 Lai et al. ..... 439/79
6,527,564 B1 * 3/2003 Yeh ..... 439/76.1
6,554,642 B1 * 4/2003 Xiang et al. ..... 439/567

* cited by examiner

*Primary Examiner*—Hien Vu
(74) *Attorney, Agent, or Firm*—David A. Belasco; Belasco Jacobs & Townsley, LLP

(57) ABSTRACT

A dustproof plate fixture for an electrical connector having a housing with multiple pins and a cover connected to the housing includes a recess, a pair of cutouts in opposite sides of a dustproof plate, a pair of retainers each having a base plate and a through hole for alignment with one of two opposite combining holes in the housing and extension legs, pressing elements each having a pressing plate received in one of the cutouts to engage with a corresponding one of the base plates, a sleeve extendable into one of the combining holes and one of the connection holes, and two securing elements each extendable into one of the connection holes and into one of the sleeves to threadingly engage with the corresponding sleeve, engagement of the pressing elements, the retainers, the dustproof plate, the housing and the cover is secured.

1 Claim, 8 Drawing Sheets

DUSTPROOF PLATE FIXTURE FOR AN ELECTRICAL CONNECTOR

CROSS REFERENCE

The present invention is a continuation in part (CIP) of the application Ser. No. 10/162,517 filed on Jun. 3, 2002 by the same applicant of the referenced application, now abandoned.

BACKGROUND OF THE INVENTION

1. Field of the Invention

The present invention relates to a dustproof plate fixture, and more particularly to a dustproof plate fixture adapted to securely connect the dustproof plate to a back of an electrical connector.

2. Description of Related Art

It is found that dust and moisture can penetrate to the interior of electrical connectors, whereby performance of the connector is impaired. To try to prevent this a dustproof plate is mounted on a back of a connector so as to isolate the dust, moisture etc. A conventional dustproof plate is shown in FIG. 6, wherein the dustproof plate (3) has a wedge (32) formed on a top edge of the dustproof plate (3) and two steps (31) respectively formed on opposite sides of the dustproof plate (3). An electrical connector (2) has a cutout (231) defined in a rear side face of the connector (2) to correspond to the wedge (32), and two tracks (21) respectively formed on two opposite sides of the connector (2) to correspond to the two steps (31).

When the conventional dustproof plate (3) is to be mounted on the connector (2), the steps (31) of the dustproof plate (3) are first slid into the corresponding tracks (21). After the steps (31) are inserted and slid into the tracks (21), the wedge (32) is securely received in the cutout (231) so that the dustproof plate (3) is able to prevent dust and moisture from going into the interior of the connector (2) to influence the electrical performance of the connector (2).

From the structure of the dustproof plate (3) and the corresponding structure of the connector (2), it is to be noted that the dustproof plate (3) has constant friction with the connector (2) when mounting and de-mounting the dustproof plate (3) to the connector (2). That is, a friction is generated between the steps (31) and the side walls defining the tracks (21) and it will gradually reduce the tightness between the dustproof plate (3) and the connector (2). When small rifts happen due to the friction between the dustproof plate (3) and the connector (2), the electrical performance is greatly hindered.

To overcome the shortcomings, the present invention tends to provide an improved dustproof plate fixture to mitigate and obviate the aforementioned problems.

SUMMARY OF THE INVENTION

The primary objective of the present invention is to provide an improved dustproof plate fixture for an electrical connector so as to eliminate the possibility of having friction between the dustproof plate and the connector and thus maintain the tightness therebetween.

Another objective of the present invention is that the dustproof plate has a bottom face tapered in thickness such that when the pins of the electrical connectors are welded to the housing of the electrical connector, damage to the pins is minimized.

Still another objective of the present invention is that the dustproof plate has positioning bosses formed on a rear face of the dustproof plate to correspond to the positioning holes in the housing such that when the dustproof plate is engaged with the housing, the mutual corresponding relationship between the positioning bosses and the positioning holes enhances the engagement between the housing and the dustproof plate.

In order to accomplish the foregoing objective, the dustproof plate fixture of the present invention includes a pair of retainers respectively adjacent to a side of a dustproof plate, a pair of pressing elements respectively corresponding to and engaging with one of the retainers and two securing elements adapted to extend through a cover, a housing, a corresponding one of the retainers and into a corresponding one of the pressing elements to secure engagement between the pressing element and the retainer such that the pressing elements, the retainers, the housing and the cover are securely connected to one another.

Other objects, advantages and novel features of the invention will become more apparent from the following detailed description when taken in conjunction with the accompanying drawings.

DETAILED DESCRIPTION OF THE PREFERRED EMBODIMENT

Figure 1:
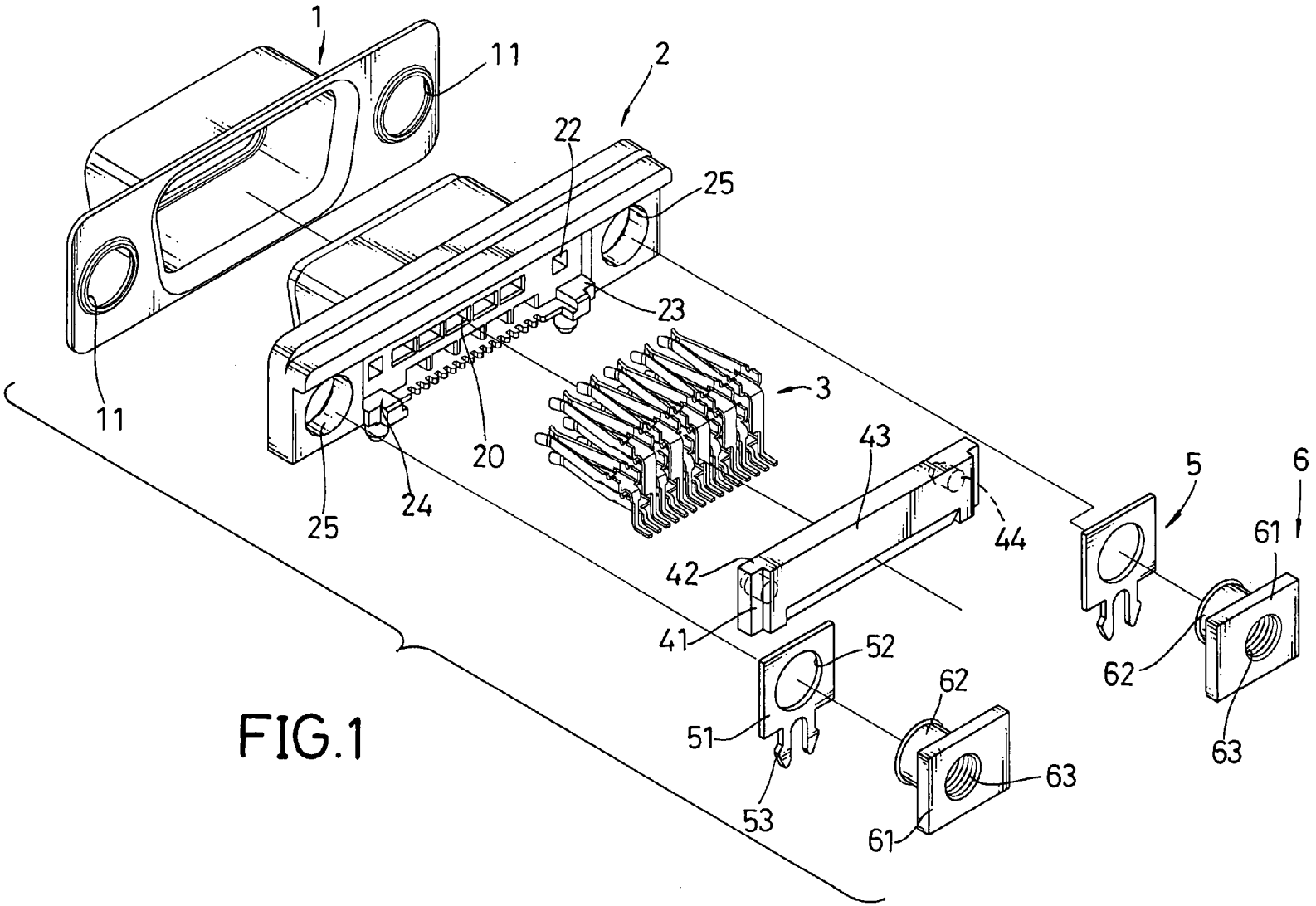
FIG. 1 is an exploded perspective view of the dustproof plate fixture in association with the electrical connector.

With reference to FIG. 1, it is to be noted that the dustproof plate fixture for an electrical connector has a cover (1) having a pair of opposite connection holes (11), a housing (2) attached to and engaged with the cover (1), and pins (3) supported by the housing (2) and extending out of the cover (1).

The dustproof plate fixture in accordance with the present invention has two cutouts (41) adapted to be defined in opposite sides of a dustproof plate (4), a first step (42) and a second step (43) formed on the first step (42), a pair of retainers (5) and a pair of pressing elements (6). A pair of positioning bosses (44) is adapted to be defined in a rear face of the first step (42).

A recess (21) is adapted to be defined in a rear face of the housing (2) and two positioning holes (22) are adapted to be defined in opposite sides of a bottom face defining the recess (21) to correspond to the positioning bosses (44). A first support (23) and a second support (24) are oppositely formed on the bottom face defining the recess (21) to correspond to the dustproof plate (4). Two combining holes (25) are oppositely defined in the housing (2). It is appreciated that the housing (2) has multiple insertion holes (20) defined in the rear face of the housing (2) for extension of the pins (3).

Each retainer (5) is defined with a base plate (51), a through hole (52) defined through the base plate (51) to correspond to one of the combining holes (25) of the housing (2), and extension legs (53) extending from a bottom face of the base plate (51).

Each pressing element (6) is provided with a pressing plate (61), a sleeve (62) extending from a rear face of the pressing plate (61) and a threaded hole (62) in communication with the sleeve (62) and corresponding to the through hole (52) of the retainer (5).

Figure 2:
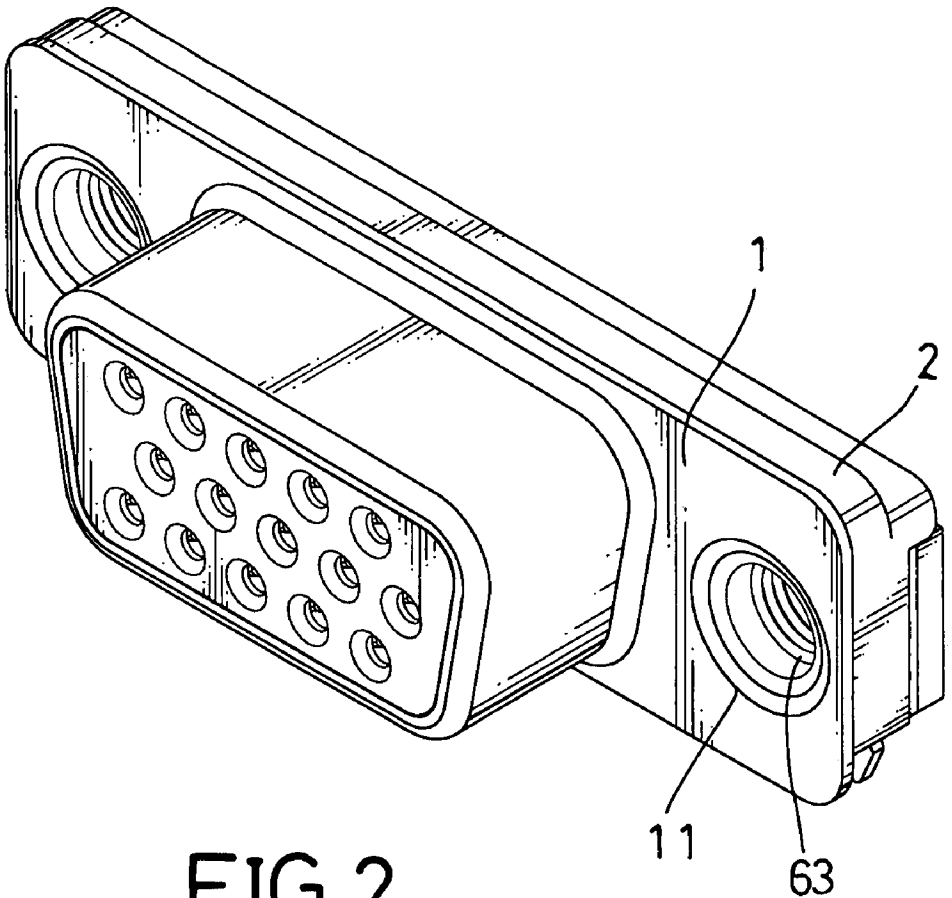
FIG. 2 is a perspective view showing the assembly of the dustproof plate fixture with the securing element left outside the assembly.
Figure 3:
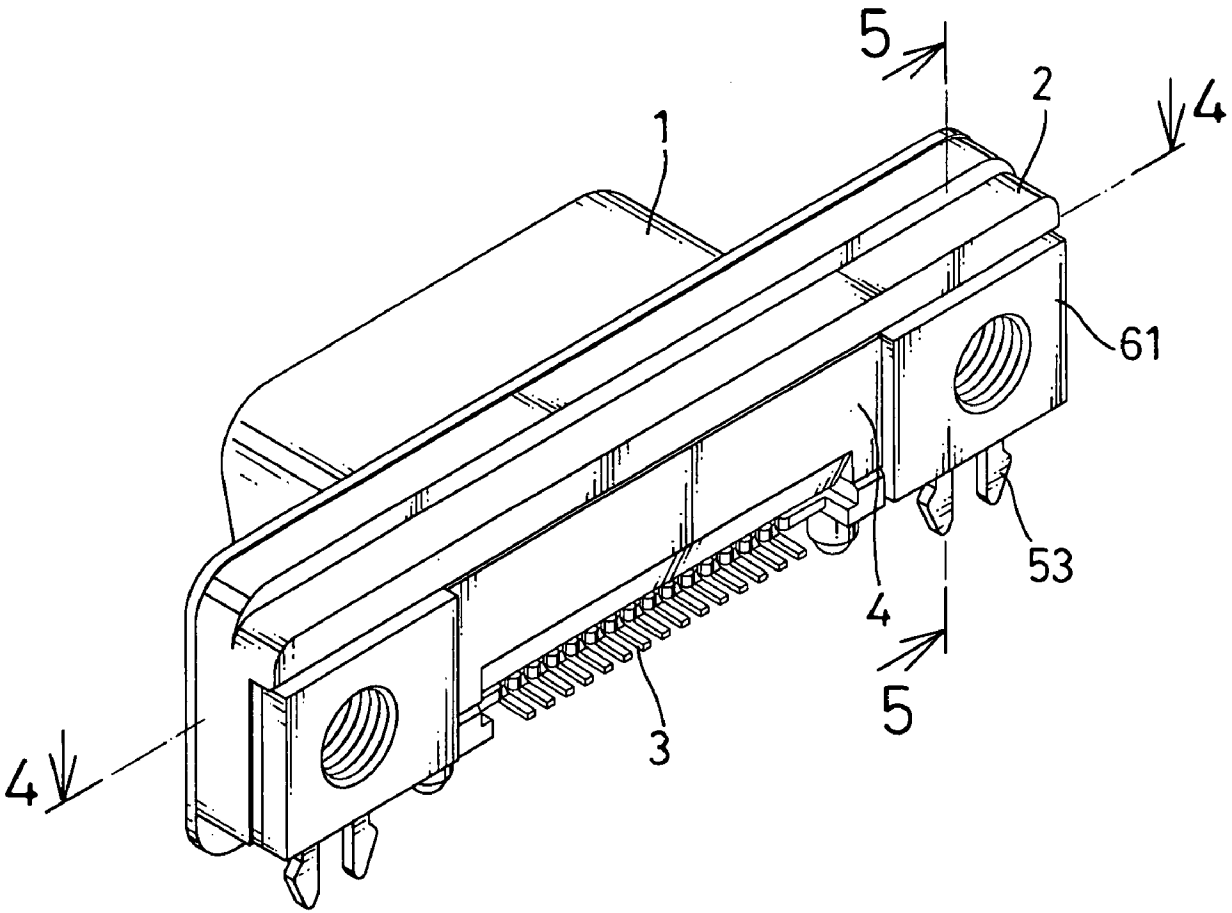
FIG. 3 is a perspective view showing the complete assembly of the electrical connector.
Figure 4:
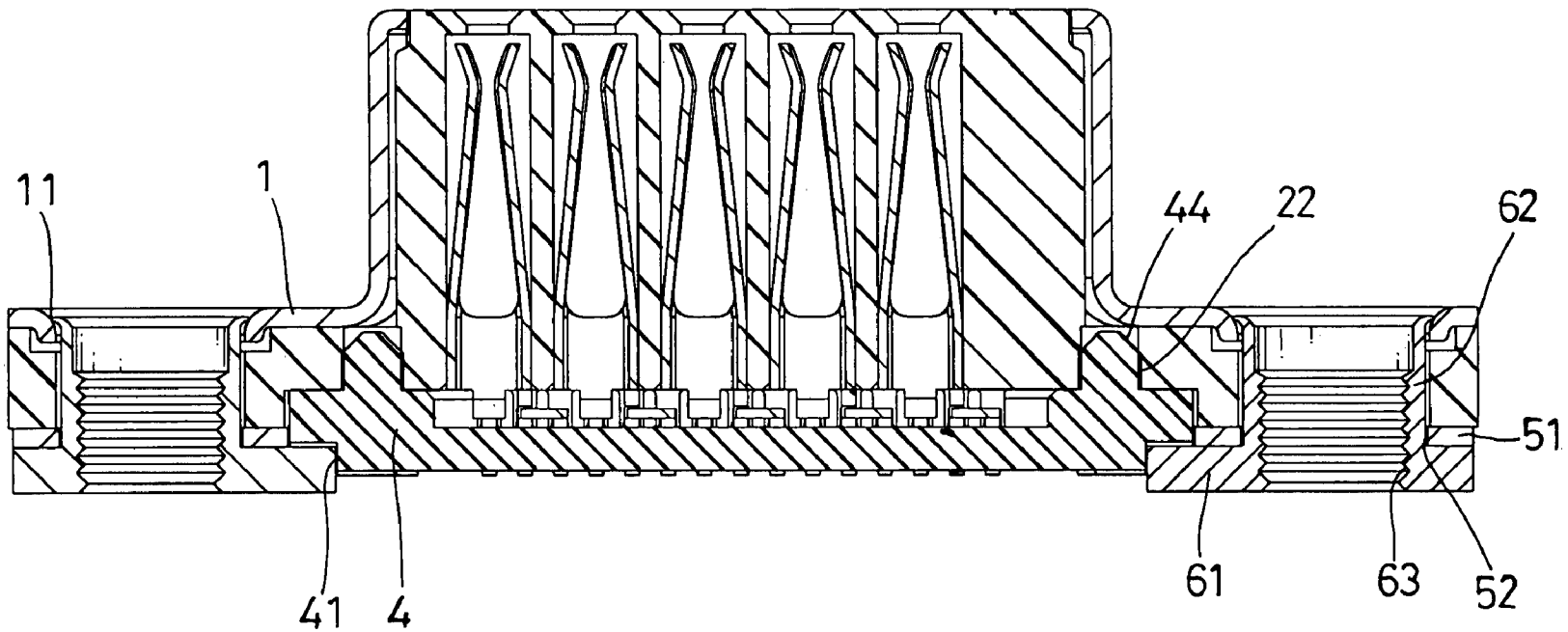
FIG. 4 is a cross sectional view showing internal structure of the electrical connector according to line 4—4 in FIG. 3.

With reference to FIGS. 2, 3 and 4, when the electrical connector is to be assembled, the pins (3) are inserted into the insertion holes (20) of the housing (2) and extend out of the cover (1) where the combining holes (25) are aligned with the connection holes (11). Then the first step (42) of the dustproof plate (4) is supported and received in the recess (21) with the positioning bosses (44) received in the positioning holes (22). Due to the formation of the recess (21) and the first step (42), the combination of the dustproof plate (4) and the housing (2) is compact. Thereafter, the two retainers (5) are placed adjacent to opposite sides of the first step (42) of the dustproof plate (4) with the through holes (52) respectively aligned with one of the combining holes (25). Then the two sleeves (62) are extended into the through holes (52), the combining holes (25) and the connection holes (11), wherein the pressing plate (61) is securely engaged with a corresponding one of the base plates (51). It may be appreciated that after the sleeves (62) are extended into the connection holes (11), distal ends of the sleeves (62) are flush with a rear face of the cover (1). Last, two securing elements (not shown), preferably threaded bolts, are implemented to extend into the connection holes (11) and the threaded holes (63) to secure engagement of the retainers (5), the dustproof plate (4), the housing (2) and the cover (1).

Figure 5:
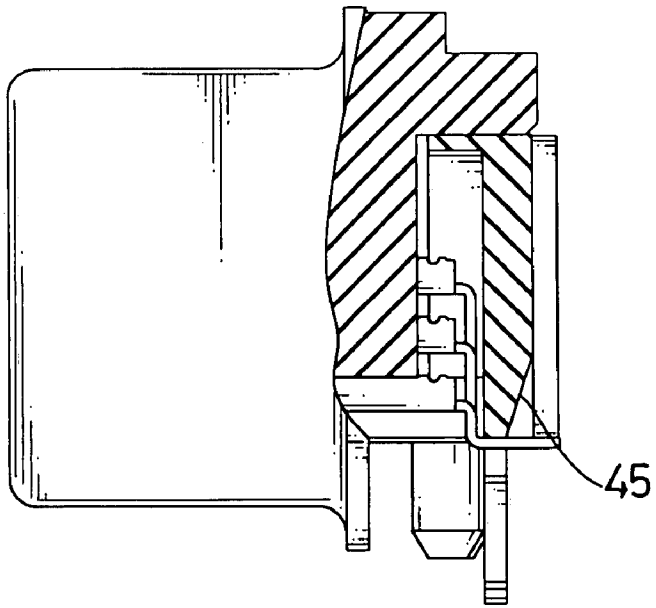
FIG. 5 is a partial cross sectional view showing that the dustproof plate has a bottom face tapered in thickness such that the pins of the electrical connector are protected from damage during welding process.
Figure 5A:
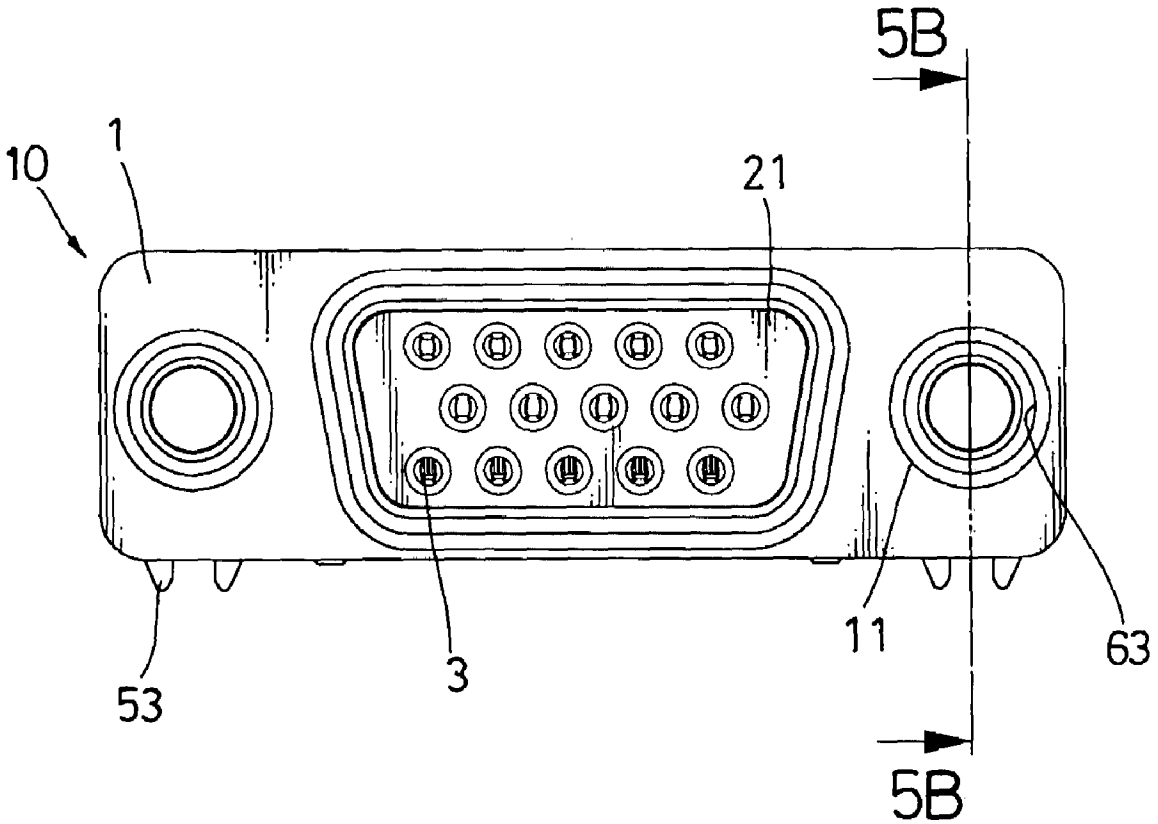
FIG. 5A is a perspective view of the dustproof plate fixture from a different angle relative to that of FIG. 2.
Figure 5B:
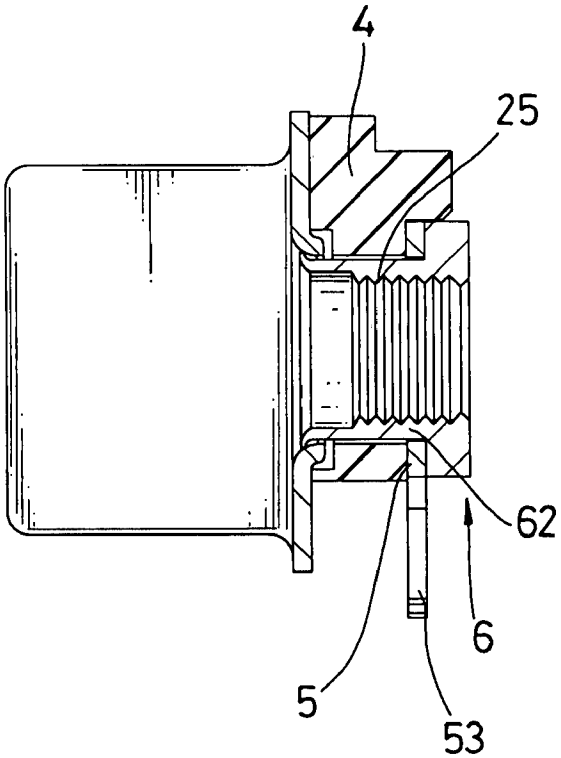
FIG. 5B is a partial cross sectional view by taking line 5B—5B in FIG. 5A.
Figure 6:
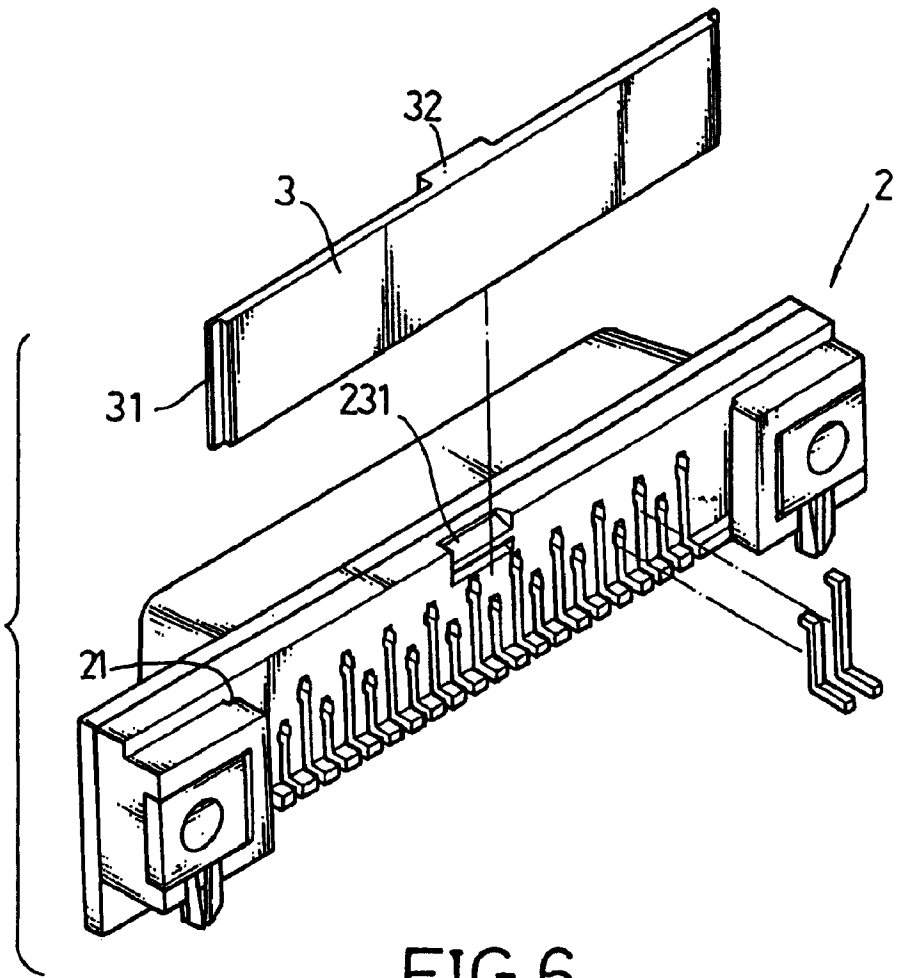
FIG.6 PRIOR ART
FIG. 6 is a perspective view showing the structure of the conventional dustproof plate and the corresponding structure in the electrical connector.

With reference to FIGS. 5, 5A and 5B, it is noted that the dustproof plate (4) has a bottom face (45) tapered in thickness such that when the pins (3) are welded to the housing (2), the welding process is easy to proceed such that the pins (3) are protected from damage.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dustproof plate fixture adapted to engage with an electrical connector having a housing with multiple pins extended therethrough and a cover securely connected to the housing, the dustproof plate fixture comprising:

a recess in a rear face of the housing;

a pair of positioning holes defined in the recess and a pair of positioning bosses formed on a rear face of the dustproof plate to be fitted into the positioning holes;

two supports oppositely formed on a bottom face of the recess;

two cutouts in opposite sides of a dustproof plate so as to form a first step and a second step;

a pair of retainers each having a base plate adapted to be adjacent to a side of the dustproof plate and a through hole defined through the base plate for alignment with one of two opposite combining holes in the housing and extension legs extending out from a bottom face of the base plate;

two pressing elements each having a pressing plate received in a corresponding one of the cutouts to engage with a corresponding one of the base plates, a sleeve extending out from the pressing element and extendable into one of the through holes, one of the combining holes of the housing and one of the connection holes of the cover; and two securing elements each being extended into a corresponding one of the connection holes of the cover and into one of the sleeves to threadingly engage with the corresponding sleeve such that engagement of the pressing elements, the retainers, the dustproof plate, the housing and the cover is secured wherein the dustproof plate has a bottom face tapered in thickness such that a welding process to the pin is easy and thereby the pins are protected from damage.

* * * * *